US012474136B2

(12) United States Patent
Oliver et al.

(10) Patent No.: US 12,474,136 B2
(45) Date of Patent: Nov. 18, 2025

(54) FIREARM SUPPRESSOR WITH PROGRESSIVE ROTATION BAFFLE ARRANGEMENT

(71) Applicant: Rough Rider Suppressors, LLC, Hawley, MN (US)

(72) Inventors: Russ Oliver, Draper, UT (US); Austin Peterson, Hawley, MN (US); Bryce Oakes, Fosston, MN (US)

(73) Assignee: Rough Rider Suppressors, LLC, Hawley, MN (US)

( * ) Notice: Subject to any disclaimer, the term of this patent is extended or adjusted under 35 U.S.C. 154(b) by 0 days.

(21) Appl. No.: 18/492,636

(22) Filed: Oct. 23, 2023

(65) Prior Publication Data

US 2024/0133650 A1 Apr. 25, 2024
US 2024/0230266 A9 Jul. 11, 2024

Related U.S. Application Data

(60) Provisional application No. 63/380,702, filed on Oct. 24, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS 1,017,003 A 2/1912 Kenney
1,242,890 A * 10/1917 Sheppard ..... F41A 13/12 415/72
1,341,363 A * 5/1920 Fiala ..... F41A 21/30 89/14.4
1,505,893 A * 8/1924 Hunter ..... F01N 1/12 165/135
1,667,186 A * 4/1928 Bluehdorn ..... F41A 21/30 89/14.3
1,770,471 A * 7/1930 Hatcher ..... F41A 21/30 89/14.3
1,782,396 A * 11/1930 Aaron ..... F01N 1/12 181/280
1,797,310 A * 3/1931 Wright ..... F01N 1/12 181/280
2,063,270 A * 12/1936 Bacchetti-Righetti .... F01N 1/12 181/280
2,359,365 A * 10/1944 Katcher ..... F01N 1/12 181/280
2,792,760 A * 5/1957 Hammer ..... F41A 21/36 89/14.4

(Continued)

*Primary Examiner* — Joshua E Freeman
(74) *Attorney, Agent, or Firm* — Cherry Johnson Siegmund James, PC

(57) ABSTRACT

A firearm suppressor includes a first section along an axis; a second section along the axis downstream of the first section, the second section having a second section twist rate; a third section along the axis downstream of the second section, the third section having a third section twist rate, the third section twist rate greater than the second section twist rate; and a fourth section along the axis downstream of the third section, the fourth section having a fourth section twist rate, the fourth section twist rate greater than the third section twist rate.

3 Claims, 11 Drawing Sheets

(56) References Cited

U.S. PATENT DOCUMENTS 2,911,055 A * 11/1959 McDonald ..... F01N 1/12 181/280
3,500,955 A * 3/1970 Werbell ..... F41A 21/30 181/223
3,667,570 A * 6/1972 WerBell, III ..... F41A 21/30 89/14.4
3,888,331 A * 6/1975 Wang ..... F01N 1/06 181/280
4,007,574 A * 2/1977 Riddell ..... E04C 3/34 52/848
4,683,978 A * 8/1987 Venter ..... F01N 1/12 181/269
5,029,512 A * 7/1991 Latka ..... F41A 21/30 89/14.4
6,796,403 B1 * 9/2004 Laughlin ..... F01N 1/12 181/278
7,117,973 B2 * 10/2006 Graefenstein ..... F16L 55/033 181/279
7,726,444 B1 * 6/2010 Laughlin ..... F01N 1/12 181/279
8,312,962 B2 * 11/2012 Melcher ..... F01N 1/081 181/227
9,347,727 B1 5/2016 Cler
10,024,617 B1 7/2018 Moore et al.
10,030,929 B1 7/2018 Lessard
10,054,384 B1 * 8/2018 Marfione ..... F41A 21/30
10,113,826 B2 * 10/2018 Bray ..... F41A 21/34
10,126,084 B1 11/2018 Oglesby
10,228,210 B2 3/2019 Parker
10,234,231 B2 3/2019 Gianelloni, III et al.
10,254,068 B2 4/2019 Piemme et al.
10,371,476 B1 8/2019 Oglesby
10,393,463 B1 8/2019 Sanders et al.
10,415,917 B2 9/2019 White
10,458,739 B2 10/2019 Smith
10,466,003 B2 11/2019 Thompson et al.
10,480,883 B2 11/2019 Smith
10,480,888 B2 11/2019 Barrett
10,502,513 B2 12/2019 Ellison et al.
10,533,819 B2 1/2020 Thomas
10,591,238 B1 3/2020 Bader
10,634,445 B1 4/2020 Klett
10,648,756 B2 5/2020 Mooty
10,655,926 B2 5/2020 Young et al.
10,690,432 B2 6/2020 Campbell et al.
10,739,097 B1 8/2020 Gaines et al.
10,746,491 B2 8/2020 Garst et al.
10,753,699 B2 8/2020 Klett et al.
10,866,051 B2 12/2020 Thompson et al.
10,890,403 B2 1/2021 Petersen
10,890,404 B2 1/2021 Petersen
10,900,734 B2 1/2021 Hailey et al.
10,907,920 B2 2/2021 Walker
10,921,080 B2 2/2021 Hibbitts et al.
11,092,399 B2 8/2021 Washburn, III et al.
11,125,523 B2 9/2021 Petersen
11,150,045 B1 10/2021 Oglesby
11,162,753 B2 11/2021 Kras
11,248,870 B1 * 2/2022 Nagy-Zambo ..... F41A 21/30
11,255,623 B2 2/2022 Kras et al.
11,268,776 B1 3/2022 Noonan
11,280,571 B2 3/2022 Miller et al.
11,326,849 B2 5/2022 Edminster et al.
11,378,348 B2 * 7/2022 Poling ..... F41A 21/30
11,686,547 B2 * 6/2023 Kras ..... F41A 21/30 89/14.4
11,859,932 B1 * 1/2024 Kras ..... F41A 21/30
2007/0107590 A1 5/2007 Silvers
2007/0107982 A1 5/2007 Sullivan
2007/0256347 A1 11/2007 Fitzpatrick et al.
2009/0200105 A1 8/2009 Geyer, III
2009/0235568 A1 9/2009 Auvine
2010/0048752 A1 2/2010 Vignola et al.
2010/0163336 A1 7/2010 Presz, Jr. et al.
2010/0199834 A1 8/2010 Dueck et al.
2011/0067950 A1 3/2011 Shults et al.
2012/0272818 A1 11/2012 Dueck et al.
2014/0035076 A1 2/2014 Zhang et al.
2014/0224574 A1 * 8/2014 Latka ..... F41A 21/30 181/223
2014/0262605 A1 9/2014 Washburn, III et al.
2014/0353076 A1 12/2014 Bethlenfalvy
2014/0360807 A1 12/2014 McKenzie
2015/0001001 A1 1/2015 Wilson
2015/0136519 A1 5/2015 Moore
2015/0253099 A1 9/2015 Shults
2015/0260472 A1 9/2015 Smith
2016/0084602 A1 3/2016 Smith
2016/0109205 A1 4/2016 Coppinger et al.
2016/0238335 A1 8/2016 Bertschinger et al.
2017/0067711 A1 * 3/2017 Slack ..... F41A 21/30
2017/0102201 A1 4/2017 Bush
2017/0102202 A1 4/2017 Augustine et al.
2017/0160034 A1 6/2017 Parker
2017/0205174 A1 * 7/2017 Petersen ..... F41A 21/30
2017/0205175 A1 7/2017 Garst et al.
2017/0299314 A1 10/2017 Palu
2017/0321984 A1 11/2017 Palu et al.
2018/0038663 A1 2/2018 LaRue
2018/0135932 A1 5/2018 Tomczak
2018/0252489 A1 9/2018 Parker
2018/0266783 A1 9/2018 Morreau
2018/0313626 A1 11/2018 Tomczak
2018/0313627 A1 11/2018 Tomczak
2018/0340750 A1 11/2018 Mooty
2019/0257607 A1 * 8/2019 Dobrinescu ..... F41A 21/30
2020/0064099 A1 2/2020 Young et al.
2020/0096279 A1 3/2020 Hibbitts et al.
2020/0116450 A1 4/2020 Ellison et al.
2020/0224989 A1 7/2020 Bundy et al.
2020/0240737 A1 7/2020 Wheeler et al.
2020/0263947 A1 8/2020 Calderwood et al.
2021/0003360 A1 1/2021 Kras
2021/0041200 A1 * 2/2021 Kras ..... F41A 21/30
2021/0071979 A1 3/2021 Plunkett, Jr. et al.
2021/0381793 A1 * 12/2021 Slack ..... F41A 21/24
2022/0018623 A1 * 1/2022 Borunsky ..... F41A 21/30
2024/0288242 A1 * 8/2024 Kras ..... F41A 21/30

* cited by examiner

FIREARM SUPPRESSOR WITH PROGRESSIVE ROTATION BAFFLE ARRANGEMENT

BACKGROUND

The present disclosure claims priority to U.S. Provisional Patent Disclosure Ser. No. 63/380,702 filed Oct. 24, 2022.

The present disclosure relates to a firearm suppressor, and more specifically, to a progressive rotation baffle stack configuration.

The discharge of a firearm causes gases to be produced through rapid, confined burning of a propellant that accelerates a projectile which generates noise and a muzzle flash. A suppressor reduces a firearm's muzzle flash and acoustic output by slowing escaping gases when a firearm is discharged. Suppressors typically include one or more expansion chambers within a tubular body that surround the projectile path to decelerate and cool the escaping gases. These expansion chambers are divided by baffles, with several expansion chambers along the length of the tubular body. Suppressors can be a detachable accessory for attachment to a muzzle or can be integral to the barrel of a firearm.

Although effective in reducing sound and muzzle flash, suppressors may, however, increase the back pressure of the gas in the barrel which may influence the firearm's operation and reduce the service life thereof.

SUMMARY

A firearm suppressor according to one disclosed non-limiting embodiment of the present disclosure includes a first section along an axis; a second section along the axis downstream of the first section, the second section comprises a multiple of second section baffles, each of the multiple of second section baffles comprising a cross-sectional geometry that is twisted around the axis at a second section twist rate; a third section along the axis downstream of the second section, the third section comprises a multiple of third section baffles, each of the multiple of third section baffles comprising a cross-sectional geometry that is twisted around the axis at a third section twist rate, the third section twist rate greater than the second section twist rate; and a fourth section along the axis downstream of the third section, the fourth section comprises a multiple of fourth section baffles, each of the multiple of fourth section baffles comprising a cross-sectional geometry that is twisted around the axis at a fourth section twist rate, the fourth section twist rate greater than the third section twist rate.

A further embodiment of any of the foregoing embodiments of the present disclosure includes that the second section twist rate is a 30 degree twist rate and the cross-sectional geometry is triangular.

A further embodiment of any of the foregoing embodiments of the present disclosure includes that the third section twist rate is a 23 degree twist rate and the cross-sectional geometry is triangular.

A further embodiment of any of the foregoing embodiments of the present disclosure includes that the fourth section twist rate is a 15 degree twist rate and the cross-sectional geometry is triangular.

A further embodiment of any of the foregoing embodiments of the present disclosure includes that the second section twist rate is a 30 degree twist rate, the third section twist rate is a 23 degree twist rate, and the fourth section twist rate is a 15 degree twist rate and the cross-sectional geometry is triangular.

A further embodiment of any of the foregoing embodiments of the present disclosure includes that the first section is a blast chamber.

A further embodiment of any of the foregoing embodiments of the present disclosure includes that the third section twist rate is 80%-70% of the second section twist rate.

A further embodiment of any of the foregoing embodiments of the present disclosure includes that the fourth section twist rate is 70%-60% of the third section twist rate.

A further embodiment of any of the foregoing embodiments of the present disclosure includes that the third section twist rate is 80%-70% of the second section twist rate, and the fourth section twist rate is 70%-60% of the third section twist rate.

A further embodiment of any of the foregoing embodiments of the present disclosure includes that the second section twist rate is a 30 degree twist rate, the third section twist rate is a 23 degree twist rate, and the fourth section twist rate is a 15 degree twist rate.

A further embodiment of any of the foregoing embodiments of the present disclosure includes that a length of the third section is greater than a length of the second section, and a length of the fourth section is less than the length of the third section.

A further embodiment of any of the foregoing embodiments of the present disclosure includes that the length of the third section is about 115% the length of the second section, and the length of the fourth section is about 52% of the length of the third section.

A further embodiment of any of the foregoing embodiments of the present disclosure includes that the third section twist rate is 80%-70% of the second section twist rate, and the fourth section twist rate is 70%-60% of the third section twist rate.

A further embodiment of any of the foregoing embodiments of the present disclosure includes that the second section twist rate is a 30 degree twist rate, the third section twist rate is a 23 degree twist rate, and the fourth section twist rate is a 15 degree twist rate.

A further embodiment of any of the foregoing embodiments of the present disclosure includes that the first section is a blast chamber.

A further embodiment of any of the foregoing embodiments of the present disclosure includes that the first section, the second section, the third section, and the fourth section are additively manufactured in an integral manner with a body.

A further embodiment of any of the foregoing embodiments of the present disclosure includes that a muzzle end of the fourth section is frustoconical.

A further embodiment of any of the foregoing embodiments of the present disclosure includes that each of the baffles in the second section, the third section, and the fourth section comprise three apertures that define three spiral paths from the second section to the muzzle end of the fourth section.

A further embodiment of any of the foregoing embodiments of the present disclosure includes that the apertures in each of the three spiral paths decrease in size from the second section to the muzzle end of the fourth section, the apertures in the second section, are larger than the apertures in the third section, which are larger than the apertures in the fourth section.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
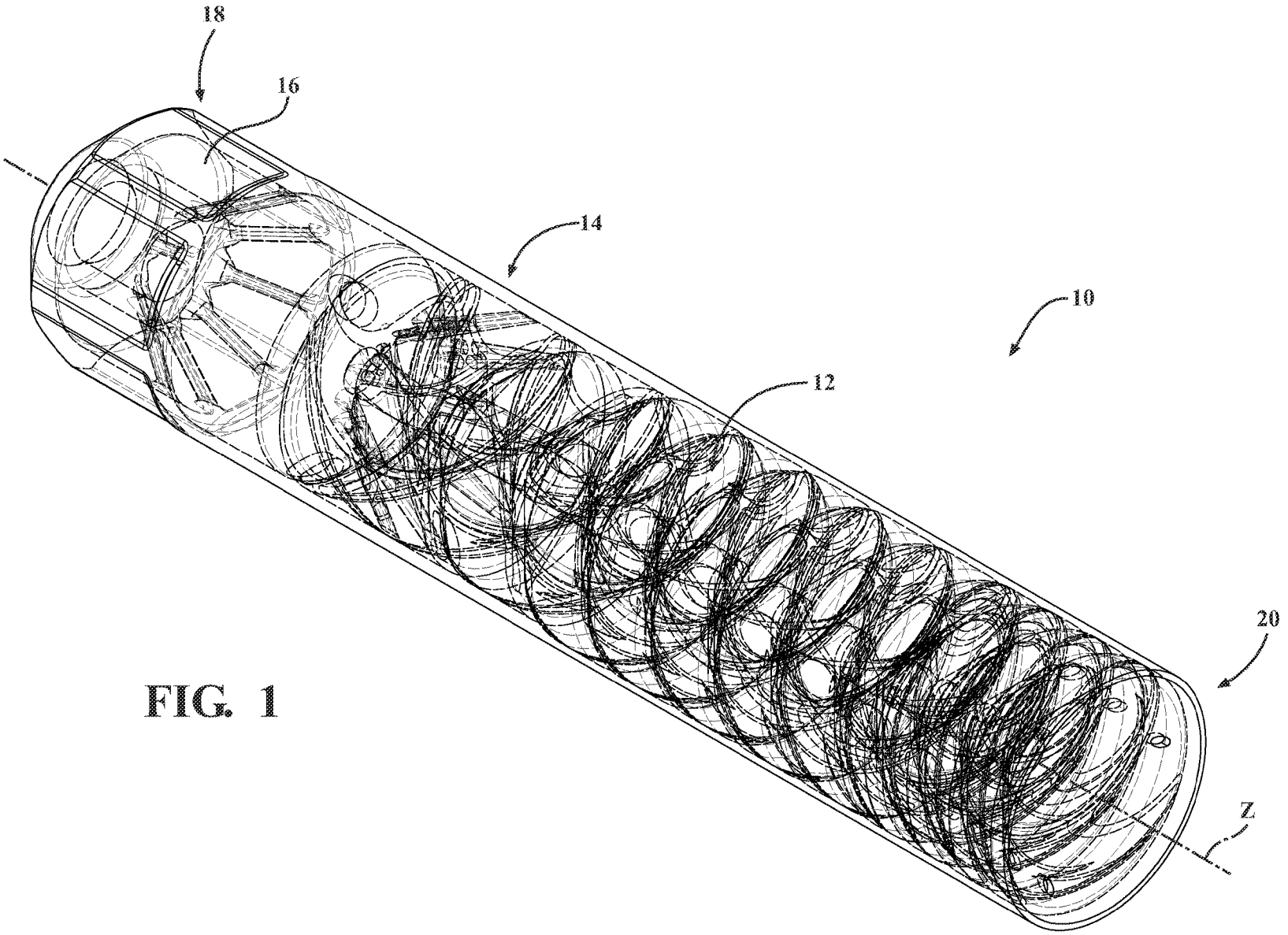
FIG. 1 is a phantom perspective view of a firearm suppressor according to one disclosed non-limiting embodiment.
Figure 2:
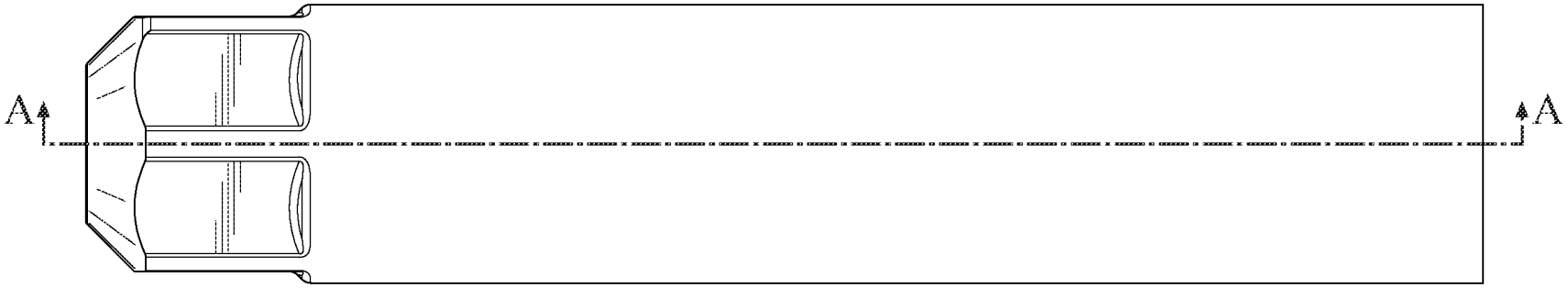
FIG. 2 is a side view of a firearm suppressor according to one non-limiting embodiment.
Figure 3:
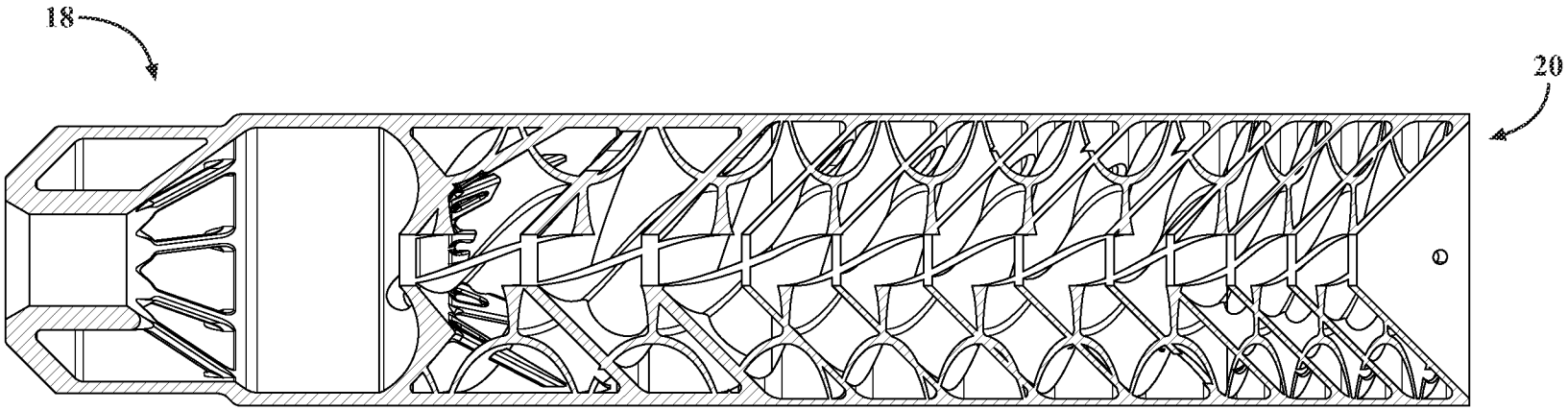
FIG. 3 is a longitudinal sectional view taken along line A-A in FIG. 2 of a baffle arrangement for a firearm suppressor according to one non-limiting embodiment.
Figure 5:
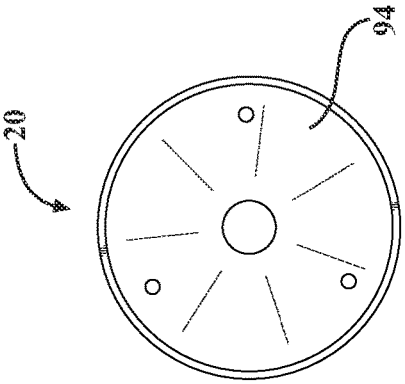
FIG. 5 is a muzzle end view of a firearm suppressor according to one non-limiting embodiment.
Figure 4:
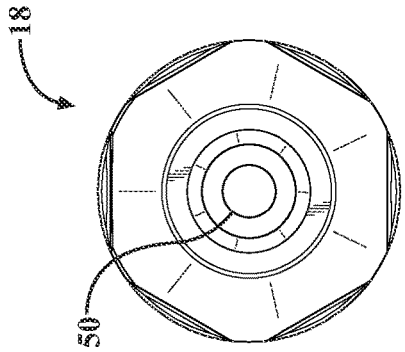
FIG. 4 is an attachment end view of a firearm suppressor according to one non-limiting embodiment.

FIG. 1 schematically illustrates a firearm suppressor 10 with a progressive rotation baffle arrangement 12 within a body 14 along an axis Z. The body 14 may be cylindrical with flats 16 arranged around an attachment end 18 (FIGS. 2, 3 and 4) opposite a muzzle end 20 (FIG. 5).

Although the progressive rotation baffle arrangement 12 is separately described with respect to the body 14, the suppressor 10 in the disclosed embodiment may be additively manufactured such that although various components are identified and described separately, such components may be manufactured in a unitary manner via additive manufacturing. It should be appreciated that, as defined herein, "additive manufacturing" processes include, but are not limited to, selective laser melting (SLM), Direct Metal Laser Sintering (DMLS), Powder-Bed Electron Beam Melting (EBM), Electron Beam Free Form Fabrication (EBF3), Laser Engineered Net Shape (LENS) and others. Although particular additive manufacturing processes are disclosed, those skilled in the art of manufacturing will recognize that any other suitable rapid manufacturing methods using layer-by-layer construction or additive fabrication can alternatively be used.

The additive manufacturing process sequentially builds-up layers of atomized alloy and/or ceramic powder material that include but are not limited to, steel alloys, stainless steel alloys, titanium alloys, nickel alloys, aluminum alloys and others in atomized powder material form. Nickel alloys may have specific benefit for parts that operate in high temperature environments, such as, for example, firearm suppressors. In one embodiment, a particular material may be Inconel 718.

The additive manufacturing process fabricates or "grows" components using three-dimensional information, for example a three-dimensional computer model. The three-dimensional information is converted into a plurality of slices, each slice defining a cross section of the component for a predetermined height of the slice. The additive manufactured component is essentially "grown" slice-by-slice, or layer-by-layer, until finished. Each layer has an example size between about 0.0005-0.001 inches (0.0127-0.0254 mm). The additive manufacturing process facilitates manufacture of the relatively complex internal passage geometry to minimize assembly details, gun-drilling, and multi-component construction.

Figure 6:
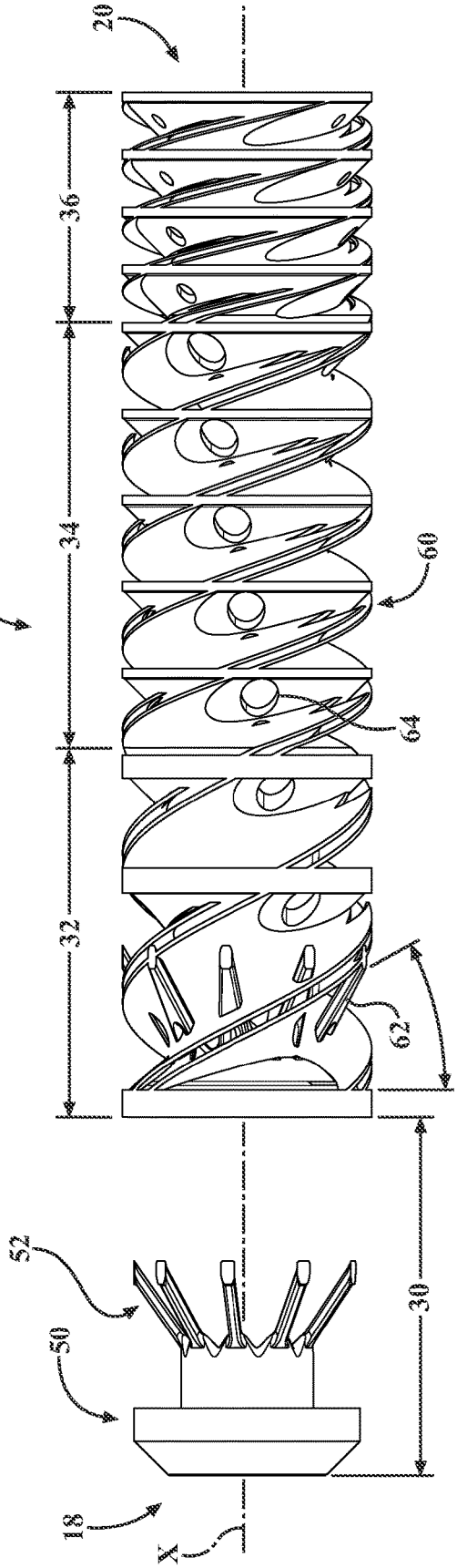
FIG. 6 is a side view of a baffle arrangement for a firearm suppressor according to one non-limiting embodiment.
Figure 7:
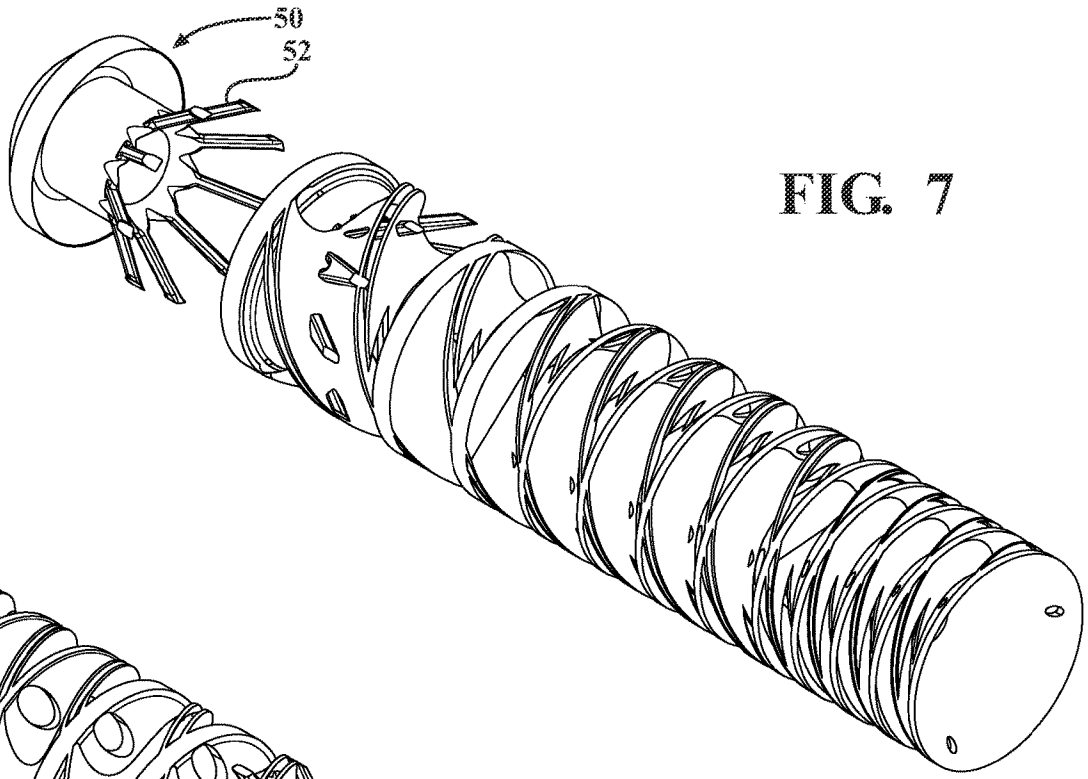
FIG. 7 is a perspective view of a baffle arrangement for a firearm suppressor from a muzzle end.
Figure 8:
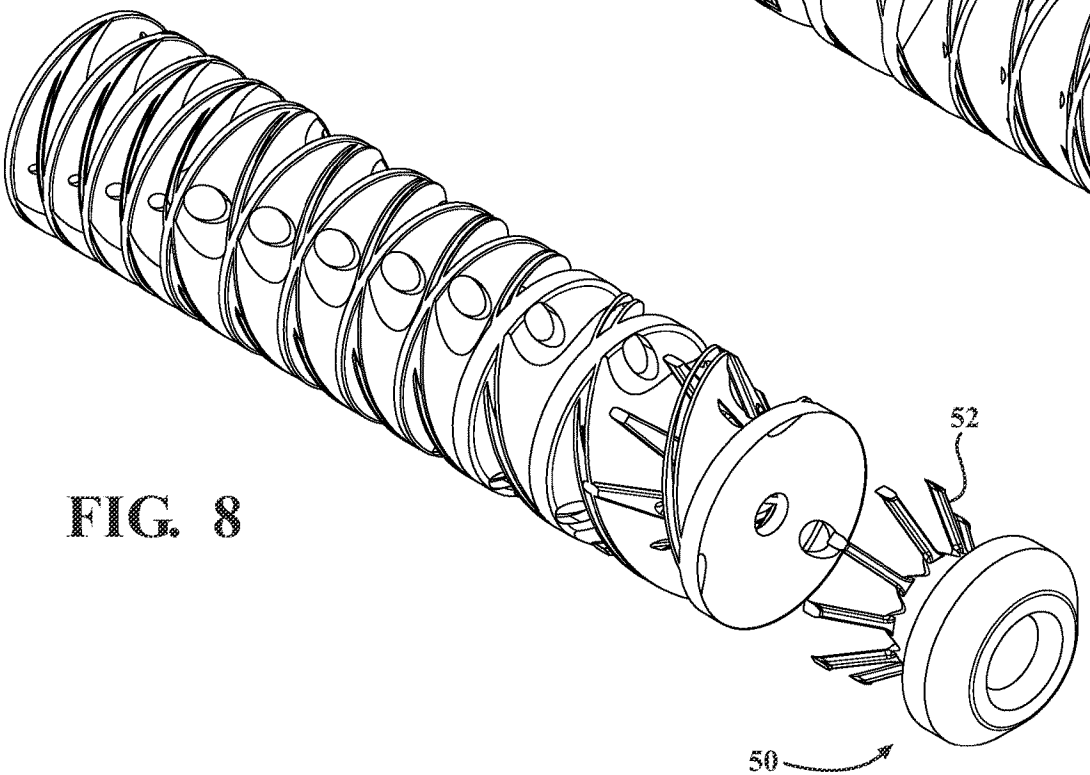
FIG. 8 is a perspective view of a baffle arrangement for a firearm suppressor from an attachment end.
Figure 9:
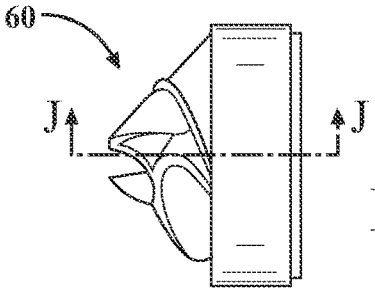
FIG. 9 is a side view of an example baffle.
Figure 10:
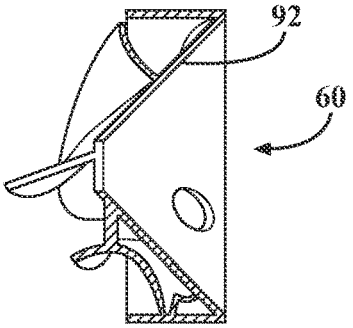
FIG. 10 is a sectional view of the example baffle taken along line J-J in FIG. 9.
Figure 11:
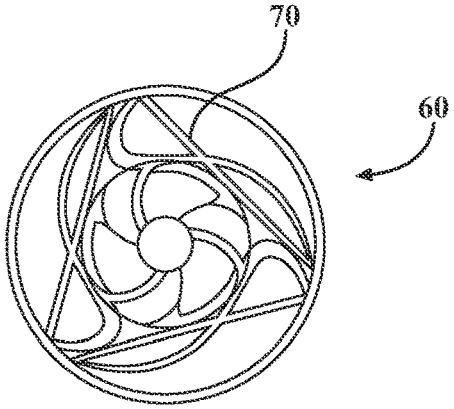
FIG. 11 is a front view of the example baffle of FIG. 9 from an attachment end.
Figure 12:
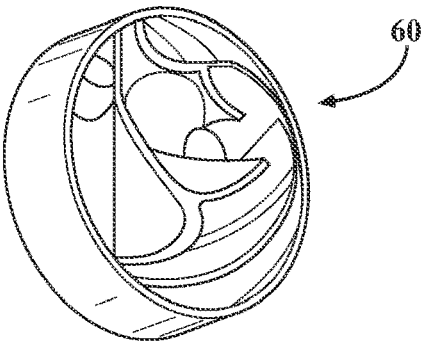
FIG. 12 is a perspective view of the example baffle of FIG. 9.
Figure 13:
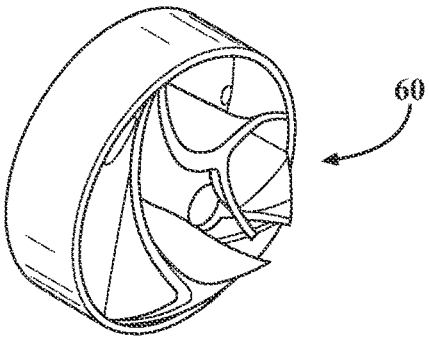
FIG. 13 is a perspective view of the example baffle of FIG. 9.
Figure 14:
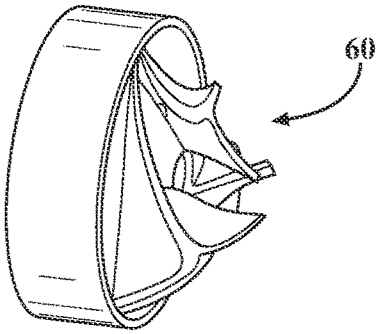
FIG. 14 is a perspective view of the example baffle of FIG. 9.
Figure 15:
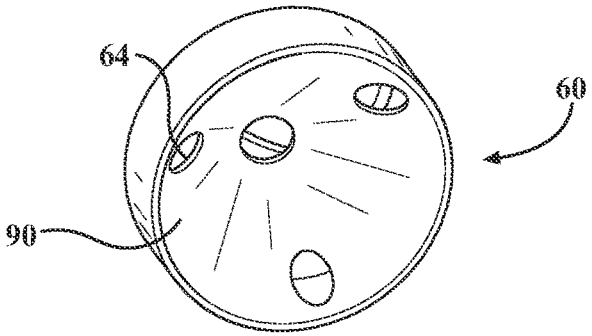
FIG. 15 is a perspective view of the example baffle of FIG. 9.

With reference to FIGS. 6, 7 and 8, the progressive rotation baffle arrangement 12 in the disclosed embodiment, includes a first section 30, a second section 32, a third section 34 and a fourth section 36 as defined from the firearm attachment end 18 to the muzzle end 20. Although particular sections are defined in this disclosed embodiment, it should be appreciated that various additional sections may alternatively or additionally provided to for example, accommodate different calibers, lengths, weights, and/or desired decibel levels, etc.

The first section 30 may be referred to as a blast chamber that does not otherwise include baffles such as those in the second section 32, the third section 34, and the fourth section 36. The first section 30 may include an attachment section 50 that is attached to a barrel of the firearm via, for example, threads such as ½-28 threads or a quick detach type coupling. The attachment section 50 may be at least partially supported by legs 52 which extend therefrom into contact with the body 14. The legs 52 may also operate to disrupt the blast from the firearm muzzle within the first section 30 and provide support for the body 14 within the blast chamber.

In the disclosed embodiment, the second section 32 has a 30 degree twist rate, the third section 34 has a 23 degree twist rate, and the fourth section 36 has a 15 degree twist rate. In this disclosed embodiment, the third section 34 twist rate is 80%-70% of the second section 32 twist rate, and the fourth section 36 twist rate is 70%-60% of the third section 34 twist rate.

In this disclosed embodiment, the first section 30 is about 1.9 inches in length, the second section 32 is about 2.0 inches in length, the third section 34 is about 2.3 inches in length, and the fourth section 36 is about 1.2 inches in length for a total overall length of about 7.5 inches by about 1.5 inches diameter.

In this disclosed embodiment, the first section 30 is about 25% of the total in suppressor length, the second section 32 is about 27% of the total in suppressor length, the third section 34 is about 31% of the total in suppressor length, and the fourth section 36 is about 16% of the total in suppressor length. In this embodiment, the third section 34 length is about 115% of the second section 32 length, and the fourth section 36 length is about 52% of the third section 34 length. That is, the third section 34 length is greater than the length of the second section 32 length, and the fourth section 36 length is less than the length of the third section 34 length.

Each of the baffles 60 (example baffle shown in FIG. 9-15) in the respective second section 32, third section 34, and fourth section 36 have a progressively increasing rotational twist rate. Although the particular example baffle shown in FIG. 9-15 is from the third section 34, it should be appreciated that the general geometric configuration applies to each section with but a change to the twist rate and spacing. The baffles 60 in the second section 32 may also include legs 62 to disrupt the blast within the second section 32 and provide support for the body 14 such as in the first section 30.

Each of the baffles 60 includes three apertures 64. The apertures 64 may be circular, oval, or of other shapes. The apertures 64 may decrease in size from the attachment end 18 to the muzzle end 20. That is, the apertures 64 in the second section 32, are larger than those in the third section 34, which are larger than those in the fourth section 36.

Figure 16:
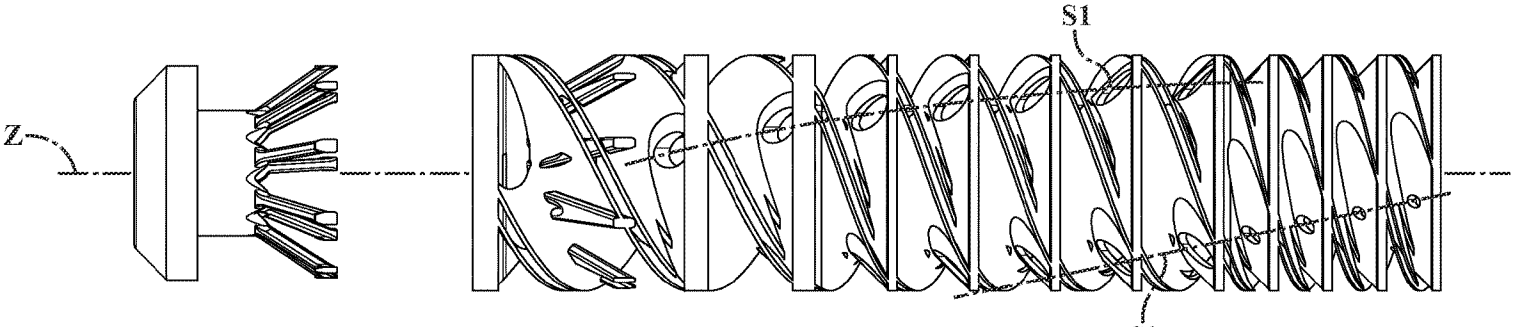
FIG. 16 is a side view of the baffle arrangement showing a first aperture path.
Figure 17:
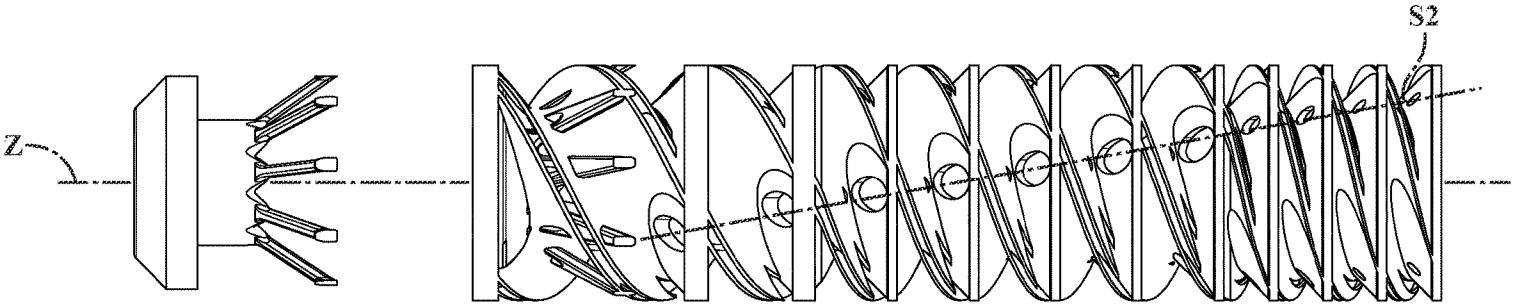
FIG. 17 is a side view of the baffle arrangement showing a second aperture path.
Figure 18:
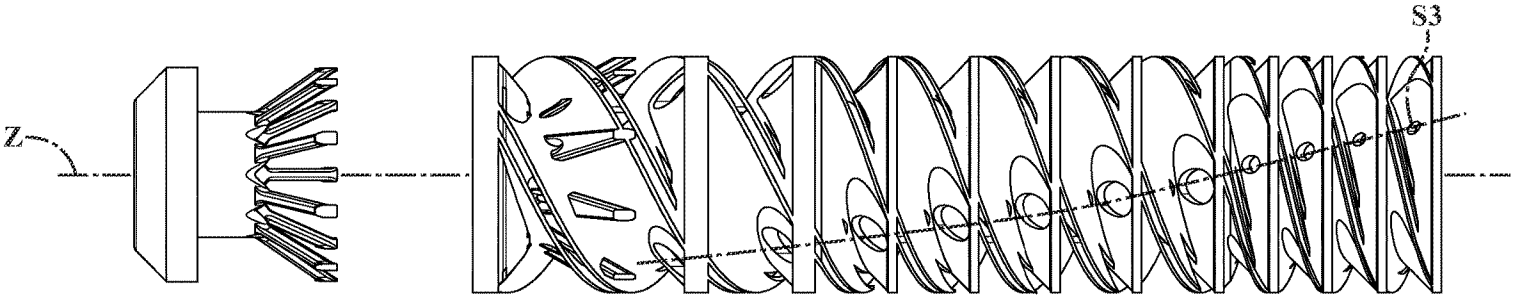
FIG. 18 is a side view of the baffle arrangement showing a third aperture path.
Figure 19:
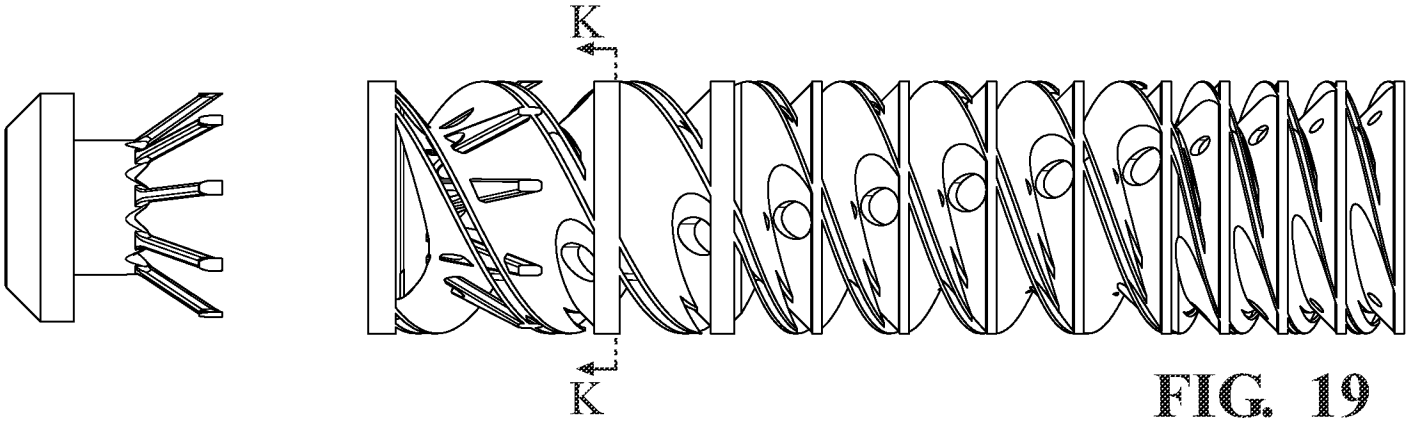
FIG. 19 is a side view of the baffle arrangement.

The apertures 64 may define three spiral paths S1, S2, and S3 (FIGS. 16, 17, and 18) from the second section 32 at the attachment end 18 to the muzzle end 20. The apertures 64, correspond to a triangular cross-sectional geometry 70 of each baffle (FIG. 19), to permit the radial chambers thereof to communicate. The paths S1, S2, and S3 also rotate about the boreline in three dimensions to mitigate blowback from the suppressor 10. That is, the paths S1, S2, and S3 allow the initial gas pressure in the suppressor 10 to be at least partially dissipated over the entire volume of the suppressor 10, which decreases the blowback pressure substantially as soon as the first chamber is pressurized by the propellant gases.

Figure 20:
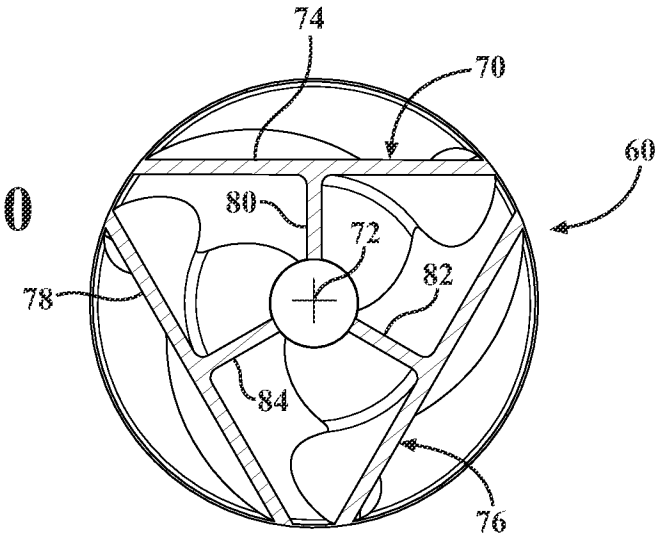
FIG. 20 is a sectional view of the example baffle taken along line K-K in FIG. 19.

With reference to FIG. 20, one representational baffle 60 from the second section 32 (FIG. 19) is shown to illustrate the triangular cross-sectional geometry 70 thereof. The triangular cross-sectional geometry 70 is twisted around a boreline 72 (also shown in FIG. 9-15) to form chambers that radially surround the boreline 72. The boreline 72 is the axis Z upon which the projectile travels. The triangular cross-sectional geometry 70 is formed from three (3) walls 74, 76, 78 that form an equilateral triangle. From a midpoint of each wall 74, 76, 78, a radial wall 80, 82, 84 extends toward the boreline 72. The walls 74, 76, 78 and the radial walls 80, 82, 84 of the triangular cross-sectional geometry 70 is that which defines the progressively increasing rotational twist rate in the second section 32, the third section 34, and the fourth section 36.

The muzzle end 90 (FIG. 15) of each baffle 60 forms a frustoconical surface 92 (FIG. 10) which interfaces with the walls 74, 76, 78 and the radial walls 80, 82, 84. That is, the walls 74, 76, 78 and the radial walls 80, 82, 84 interface with the frustoconical surface 92 of the baffle directly forward, or downstream, thereof. It should be appreciated that the baffles 60 need not be individual components but are additively manufactured in an integral manner with the body 14. The muzzle end 90 of the final baffle in the fourth section 36 forms a frustoconical end 94 (FIG. 5) of the suppressor 10.

Figure 21:
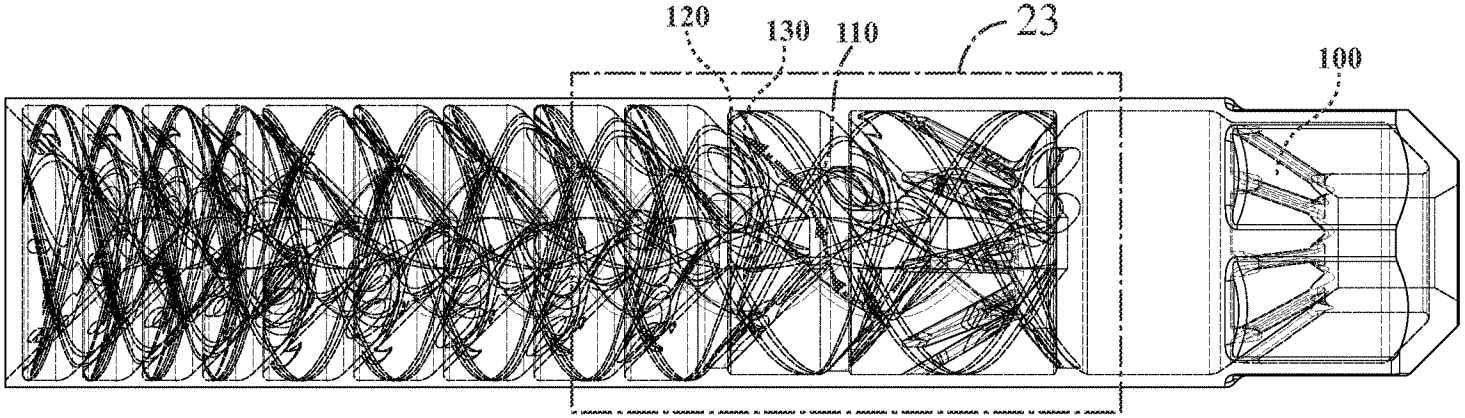
FIG. 21 is a longitudinal partial phantom view of the baffle arrangement showing an exhaust slit and flow path from an inner flow path to an outer radial flow path.
Figure 22:
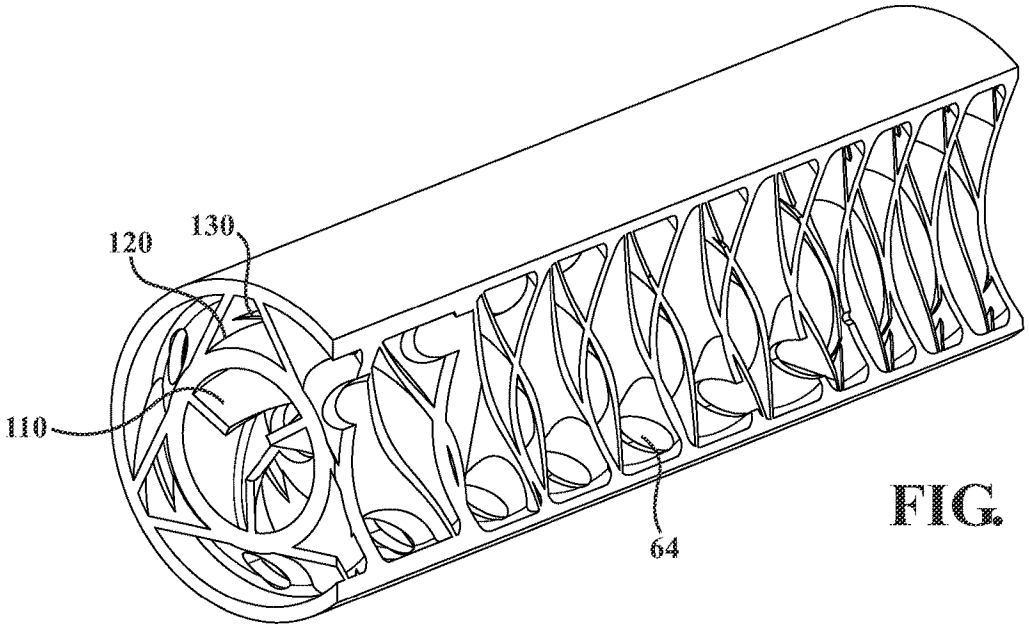
FIG. 22 is a lateral and partial longitudinal sectional view of the baffle arrangement.
Figure 23:
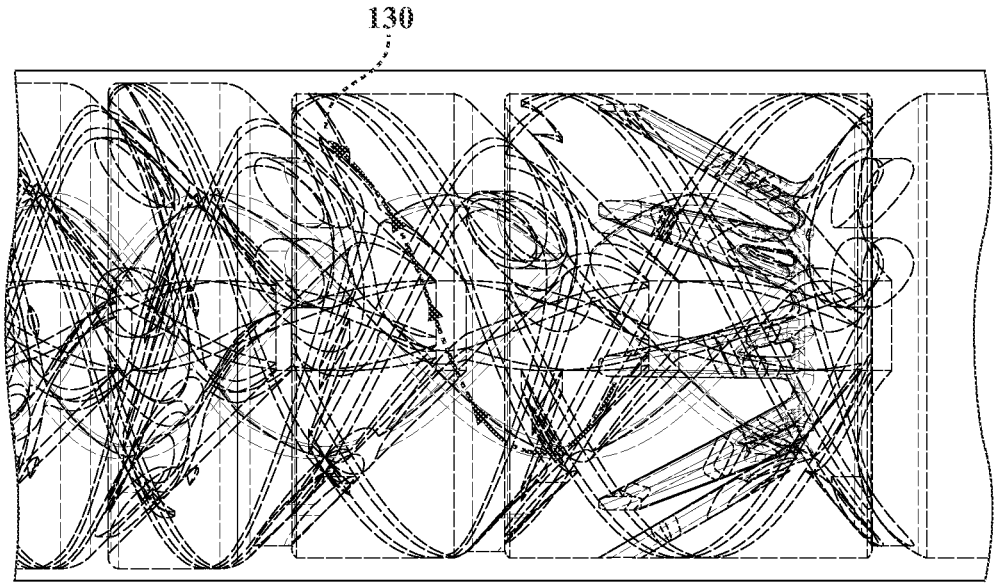
FIG. 23 is an expanded longitudinal partial phantom view of the baffle arrangement of FIG. 21 showing the exhaust slit and flow path from the inner flow path to the outer radial flow path.
Figure 24:
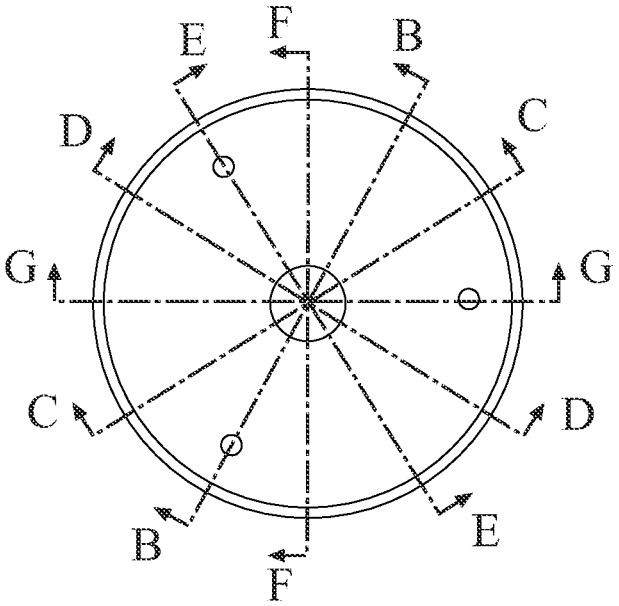
FIG. 24 is a muzzle end view for a firearm suppressor according to one non-limiting embodiment.
Figure 25:
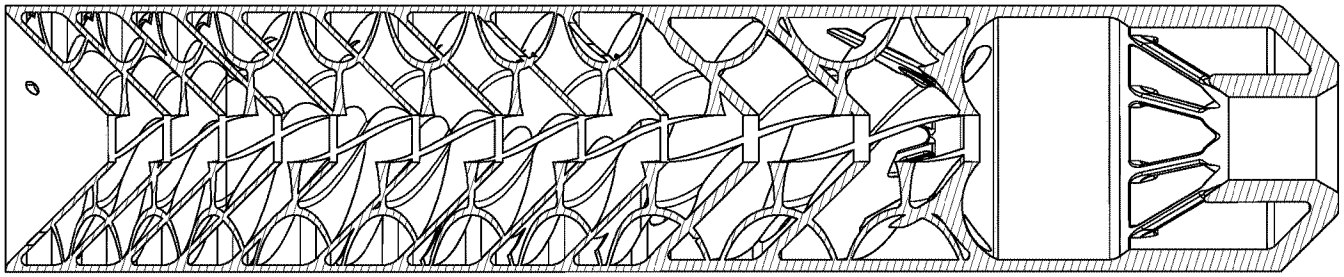
FIG. 25 is a longitudinal sectional view taken along line B-B in FIG. 24 of the firearm suppressor.
Figure 26:
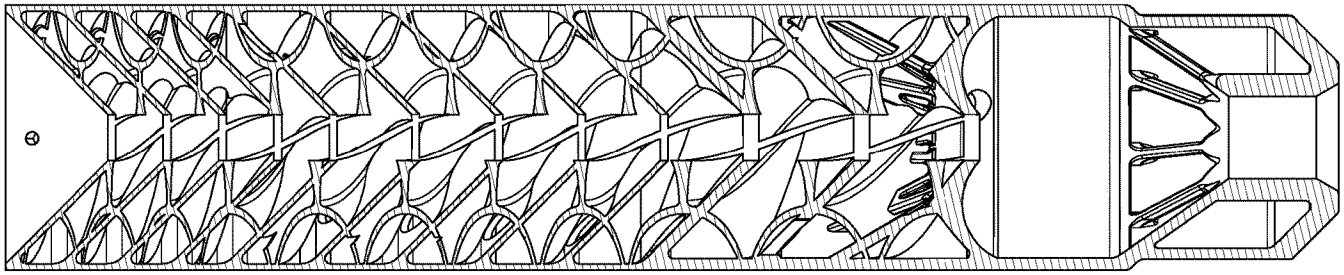
FIG. 26 is a longitudinal sectional view taken along line C-C in FIG. 24 of the firearm suppressor.
Figure 27:
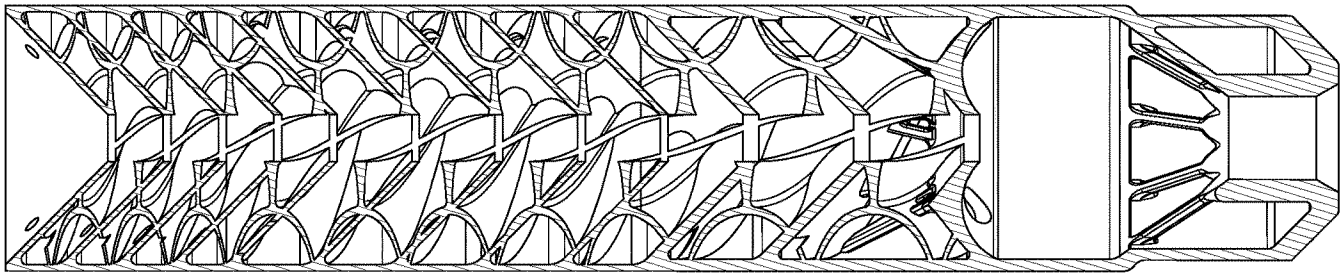
FIG. 27 is a longitudinal sectional view taken along line D-D in FIG. 24 of the firearm suppressor.
Figure 28:
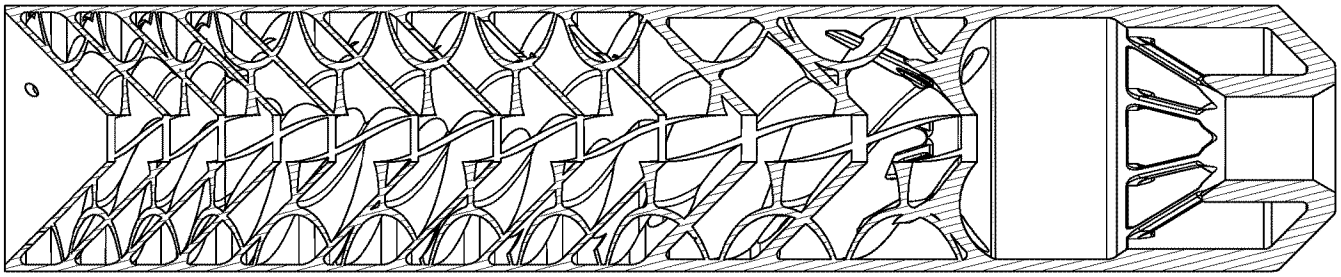
FIG. 28 is a longitudinal sectional view taken along line E-E in FIG. 24 of the firearm suppressor.
Figure 29:
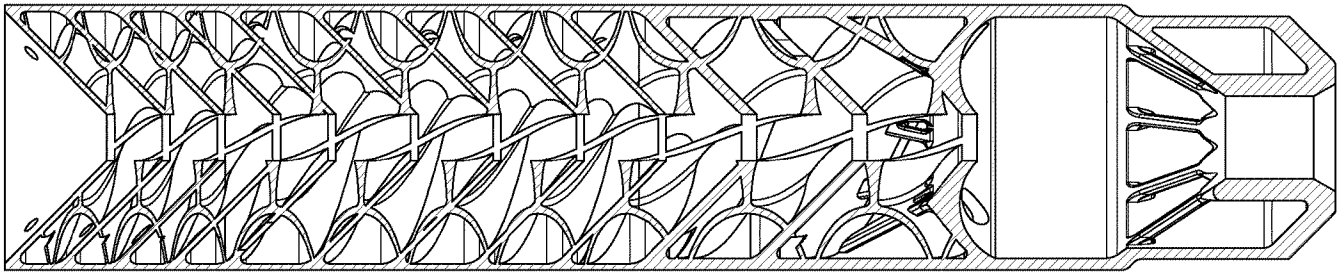
FIG. 29 is a longitudinal sectional view taken along line F-F in FIG. 24 of the firearm suppressor.
Figure 30:
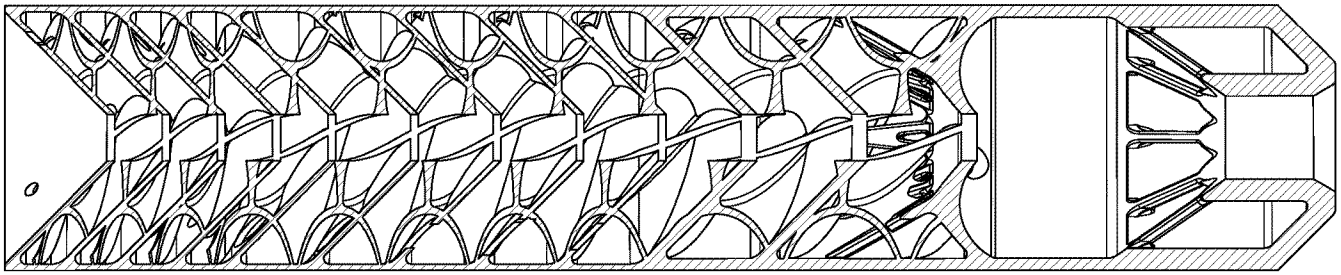
FIG. 30 is a longitudinal sectional view taken along line G-G in FIG. 24 of the firearm suppressor.

With reference to FIG. 21, the progressive rotation baffle arrangement 12 of the suppressor 10 forms a propellant gas blast chamber 100, an inner flow path 110, and an outer radial flow path 120. The blast chamber 100 is in fluid communication with a firearm muzzle (not shown) and is in fluid communication with the inner flow path 110 and the outer radial flow path 120. In the disclosed embodiment, a set of three (3) relief slits 130 are present in each baffle 60 to correspond with the triangular cross-sectional geometry 70 (FIG. 22).

In operation, the propellant gas first enters the blast chamber 100 by way of the firearm muzzle (not shown). The blast chamber 100 permits initial expansion of the propellant gas. The inner flow path 110 is in fluid communication with the outer radial flow path 120 through a plurality of relief slits 130 (FIG. 22). The inner flow path 110 and the outer radial flow path 120 rotate about the boreline in three dimensions. The outer radial flow path 120 are all interconnected via the apertures 64 (FIG. 24-30). The relief slits 130 exhaust into the outer radial pathways which are all interconnected via the apertures 64 and ultimately exit through the smallest endmost apertures 64 that form three spiral paths S1, S2, and S3 that end in the frustoconical muzzle end 20 (FIG. 5). This geometry allows far greater surface area for energy transfer than would have been available in a traditional baffle design.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A firearm suppressor, comprising:

a first section along an axis, wherein the first section is a blast chamber;

a second section along the axis downstream of the first section, the second section comprises a multiple of second section baffles, each of the multiple of second section baffles comprising a cross-sectional geometry that is twisted around the axis at a second section twist rate;

a third section along the axis downstream of the second section, a length of the third section is about 115% the length of the second section, the third section comprises a multiple of third section baffles, each of the multiple of third section baffles comprising a cross-sectional geometry that is twisted around the axis at a third section twist rate, the third section twist rate greater than the second section twist rate wherein the third section twist rate is 80%-70% of the second section twist rate;

a fourth section along the axis downstream of the third section, a length of the fourth section is about 52% of the length of the third section, the fourth section comprises a multiple of fourth section baffles, each of the multiple of fourth section baffles comprising a cross-sectional geometry that is twisted around the axis at a fourth section twist rate, the fourth section twist rate greater than the third section twist rate, the fourth section twist rate is 70%-60% of the third section twist rate;

wherein the second section twist rate is a 30 degree twist rate, the third section twist rate is a 23 degree twist rate, and the fourth section twist rate is a 15 degree twist rate; and wherein each of the baffles in the second section, the third section, and the fourth section comprise three apertures that define three spiral paths from the second section to a muzzle end of the fourth section, the muzzle end of the fourth section is frustoconical.

2. The firearm suppressor as recited in claim 1, wherein the first section, the second section, the third section, and the fourth section are additively manufactured in an integral manner with a body.

3. The firearm suppressor as recited in claim 1, wherein the apertures in each of the three spiral paths decrease in size from the second section to the muzzle end of the fourth section, the apertures in the second section, are larger than the apertures in the third section, which are larger than the apertures in the fourth section.

* * * * *